US006170451B1

(12) United States Patent
Moriya

(10) Patent No.: US 6,170,451 B1
(45) Date of Patent: Jan. 9, 2001

(54) SPARK PLUG

(75) Inventor: Toru Moriya, Kasugai (JP)

(73) Assignee: NGK Spark Plug Co., Ltd., Nagoya (JP)

( * ) Notice: Under 35 U.S.C. 154(b), the term of this patent shall be extended for 0 days.

(21) Appl. No.: 09/311,554

(22) Filed: May 14, 1999

(30) Foreign Application Priority Data

May 15, 1998 (JP) ..... 10-133600

(51) Int. Cl.[7] ..... F02P 1/00
(52) U.S. Cl. ..... 123/169 PA; 313/137
(58) Field of Search ..... 123/169 PA; 313/137

(56) References Cited

U.S. PATENT DOCUMENTS

| | | | | |
|---|---|---|---|---|
| 1,266,561 | * | 5/1918 | Depew | 123/169 PH |
| 2,171,164 | * | 8/1939 | Rabezzana | 123/169 PH |
| 2,832,245 | | 4/1958 | Burrows | 81/125 |
| 5,706,792 | * | 1/1998 | Boyer et al. | 123/169 PA |

FOREIGN PATENT DOCUMENTS 196 27 952 A1 1/1998 (DE) .

* cited by examiner

*Primary Examiner*—John Kwon
(74) *Attorney, Agent, or Firm*—Morgan, Lewis & Bockius LLP

(57) ABSTRACT

A spark plug (1) has an outer tube member (11) that covers the outer peripheral surface of the projecting part (2*a*) of an insulator (2) beyond a metallic shell (3), with its front end being coupled to the metallic shell (3). A hexagonal tool engaging portion (13) is formed in the rear end portion of the outer tube member (11). No tool engaging hexagonal portion is formed in the metallic shell (3). Accordingly, even if a plug hole (PH) of a smaller diameter is formed, the outside diameter of the insulator (2) need not be reduced accordingly since the heretofore required hexagonal portion is eliminated. As a result, the mechanical strength and withstand voltage of the insulator (2) can be ensured at adequately high levels.

4 Claims, 10 Drawing Sheets

SPARK PLUG

BACKGROUND OF THE INVENTION

1. Field of the Invention

The present invention relates to a spark plug for use in igniting internal combustion engines.

2. Description of the Related Art

As FIG. 10 shows, a spark plug 300 for firing internal combustion engines such as a gasoline engine for automotive and other applications is used after being fitted on an engine cylinder head SH by means of a fitting thread portion 301*a* formed on the outer peripheral surface of a metallic shell 301. If the spark plug is thusly fitted, a spark discharge gap g formed between a ground electrode 304 and a center electrode 303 is situated within a combustion chamber BR to serve as a site where an air-fuel mixture is fired. With the recent increase in the performance of engines, mechanisms around the cylinder head have become complicated and more engines are being operated with the spark plug 300 fitted in a deeper position through a plug hole PH made in the cylinder head.

The conventional spark plug has a hexagonal portion formed in the intermediate area of the metallic shell so as to assist in tightening of the spark plug. For fitting this spark plug on the above-described recent type of engines, the inside diameter of the spark plug hole PH must at least be equal to the sum of the outside diameter of the hexagonal portion and the allowance for engagement with a tightening tool such as a socket wrench so as permit its insertion into the plug hole. However, with the increasing complexity of the cylinder head, a smaller space is available around the valve on which the spark plug is to be fitted and this has presented with a demand for minimizing the size of the plug hole PH. For more efficient firing, there has recently been developed a new type of engine that is fitted with more than one spark plug (for example, three) in one cylinder and with such engines, the diameter of the plug hole PH is inevitably very small.

If the plug hole PH is small, the diameter of the tool such as a wrench also has to be reduced and so is the outside diameter of the hexagonal portion of the spark plug which the tool is to engage. However, with the above-described conventional spark plug, the diameter of the insulator has to be smaller than the outside diameter of the hexagonal portion and in practice a very thin (for example, no more than 5 mm in outer diameter) insulator is required. However, thin insulators are prone to be insufficient in mechanical strength and withstand voltage. What is more, when producing the insulator by shaping and sintering a powder of insulating material, it is difficult to prepare a shaped powder by pressing or other forming techniques; in addition, defects such as bends are prone to occur during sintering. These problems combine to deteriorate the process economics.

SUMMARY OF THE INVENTION

It is an object of the present invention to provide a spark plug which has no need of reducing the outside diameter of the insulator to a very small level that fits the decrease in the diameter of the plug hole formed in a cylinder head so that it can be manufactured with ease and fitted in the cylinder head without any problems.

DETAILED DESCRIPTION OF THE INVENTION

Figure 1:
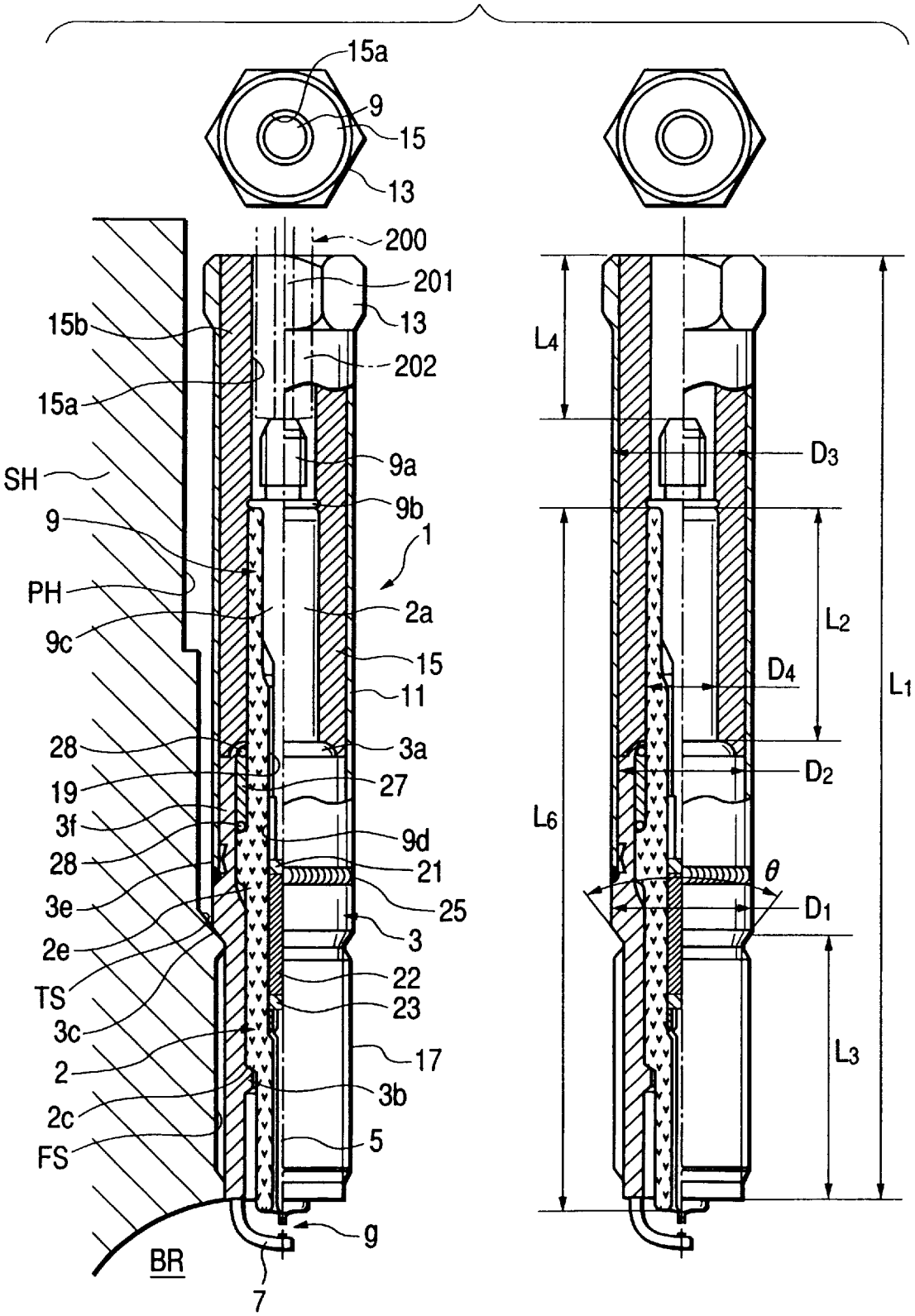
FIG. 1(*a*) and 1(B) are partial longitudinal section and plan view the spark plug according to first embodiment of the invention.

Detailed description of the present invention will be described as follows.

A spark plug according to the present invention is constituted by a shaft-shaped center electrode, a tubular metallic shell, a ground electrode, an insulator, a shaft-shaped metallic terminal, and a tool engaging portion. The tubular metallic shell is provided exterior to the center electrode and has a fitting thread portion formed on its outer peripheral surface. The ground electrode is coupled to the metallic shell and opposes to the center electrode to form a spark discharge gap therefrom. The insulator is provided within the metallic shell with its rear end portion projecting from the opening at the rear end of said metallic shell. The insulator has an axially extending through-hole in which the center electrode is provided. Within the through-hole in the insulator, the shaft-shaped metallic terminal is coupled to the rear end of the center electrode either directly or indirectly via a separate member formed of an electrically conductive material. The tool engaging portion is provided more rearward than the rear end position of either the metallic terminal or the insulator or both, the front end being the one of the longitudinal axis of the center electrode where the spark discharge gap is formed and the rear end being opposite to said front end. The tool engaging portion is coupled to the metallic shell either directly or indirectly via a separate member so that a tool engages for screwing the fitting thread portion of the metallic shell into a fitting-screw hole in an internal combustion engine.

According to the construction of the spark plug described above, the tool engaging portion for assisting in screwing the fitting thread portion of the metallic shell into the fitting-screw hole in an internal combustion engine is provided more rearward than the rear end position of either the metallic terminal or the insulator or both. Unlike in the conventional spark plug, hexagonal or other tool engaging portions are not formed in the intermediate area of the metallic shell. This offers the advantage that even if a plug hole of a smaller diameter is formed in the cylinder head, the diameter of the hole extending through the metallic shell to receive the insulator need not be reduced because the heretofore required tool engaging portion can be eliminated from the metallic shell. As a result, it is not necessary to reduce the outside diameter of the insulator to an extremely small level and its mechanical strength and withstand voltage can be ensured at adequately high levels. Further, when producing the insulator by shaping and sintering a powder of insulating material, there is only a small likelihood for problems such as the difficulty in preparing a shaped powder by pressing or other forming techniques and the occurrence of defects such as bends during sintering. This contributes to satisfy the process economics.

In addition, compared to the conventional spark plug, the tool engaging portion of the spark plug of the invention is situated close enough to the opening of the plug hole to allow for easy spark plug fitting procedures. Generally speaking, the farther away from the fitting thread portion, the smaller the likelihood of the plug hole to be subject to limitations from the space on the cylinder head. Therefore, the spark plug of the invention which has the tool engaging portion formed in a position farther away from the fitting thread portion than the conventional spark plug has the additional advantage that the area of the plug hole that corresponds to the tool engaging portion can be increased in diameter comparatively easily enough to ensure that the allowance for engagement with tightening tools such as a socket wrench can be provided with great ease.

The above-described spark plug of the invention may be so modified that the rear end portion of the insulator projects from the metallic shell. This contributes to reduce the likelihood of the occurrence of a discharge (so-called "flashover") between the metallic shell and the metallic terminal via the surface of the insulator. If desired, a outer tube member may be provided to cover the outer peripheral surface of that part of the insulator which projects from the metallic shell, with its front end being coupled to the metallic shell and with the tool engaging portion being formed in the rear end portion of the outer tube member. With this construction, the tightening force exerted by a tool can be smoothly transmitted to the fitting thread portion of the metallic shell via the outer tube member.

Specifically, the tool engaging portion may be formed on the outer surface of the rear end portion of the outer tube member. A tool comes into engagement from outside and the engaging faces on spark plug side are so shaped as to ensure that the outer tube member will not rotate about its longitudinal axis relative to the engaging faces on tool side. With this construction, the spark plug can be easily tightened by means of a tool that engages the tool engaging portion from outside.

The tool engaging portion can be formed as an engaging hole that is axially recessed from the rear end face of the outer tube member and the interior of which engages a tool. In this case, the inner faces of the engaging hole are engaging faces on spark plug side that are so shaped as to ensure that the outer tube member will not rotate about its longitudinal axis relative to the engaging faces on tool side. With this construction, the spark plug can be easily tightened by means of a tool such as a hexagonal wrench that engages the tool engaging portion from inside. It should be noted that the tool engaging portion of this alternative type may be formed in combination with the aforementioned basic type which a tool engages from outside. With this construction, the spark plug can be easily tightened by means of a tool irrespective of whether it engages the tool engaging portion from outside or inside.

In each of the tool engaging portions of the constructions described above, the engaging faces on spark plug side may be composed of at least one pair of parallel faces that lie on opposite sides of the central axis through the outer tube member. For example, they may be shaped to define a hexagonal cross section. This geometrical feature ensures more positive tool engagement, thereby allowing for greater ease in tightening the spark plug.

The outer tube member may be formed of metallic materials such as carbon steels or stainless steels. In this case, in order to reduce the chance of the occurrence of short-circuit discharge between the outer tube member and the metallic terminal which is to be supplied with high voltage, the inside of the outer tube member may be lined with an insulative protecting layer that fills the gap from the outer surface of the insulator. The insulative protecting layer is made of a polymeric material such as rubber or resin. The primary function of the insulative protecting layer is to assure insulation between the outer tube member and the metallic terminal. Moreover, depending on the material of which it is made, the layer serves to absorb the impact of an external force exerted on the outer tube member. If, for example, vibrations from the engine or the like are intensely exerted on the outer tube member after the spark plug is fitted, friction develops between the metallic terminal and the high-voltage lead portion of an ignition coil connected to that terminal and the resulting wear produces metal shavings that may potentially cause adverse effects on insulation. However, if the insulative protecting layer is provided in the way described above, the transmission of vibrations to the metallic terminal is effectively suppressed to reduce the likelihood of the problem.

The outer tube member may be so shaped that it extends more rearward than the rear end positions of both the insulator and the metallic terminal. In this case, the insulative protecting layer may be formed as an insulating buffer layer that is made of an insulating, soft, elastic material such as rubber. This provides for further enhancement in the ability to attenuate or absorb impact or vibrations. The insulating buffer layer may be so shaped as to have an extension passing through the outer tube member up to a point more rearward than the rear end positions of both the insulator and the metallic terminal. The extension may be so shaped that a high-voltage lead insertion hole through which the high-voltage lead portion of the ignition coil is inserted and fixed is axially formed in a section perpendicular to the axis of said extension and in a position corresponding to the metallic terminal. When the high-voltage lead portion is forced into the high-voltage lead insertion hole with the insulating buffer layer being deformed elastically, the resulting friction allows the high-voltage lead portion to be easily connected to the spark plug.

The inner peripheral surface of the high-voltage lead insertion hole may be provided with an engaging recess or rib which is to maintain engagement with an anti-slip rib or recess that are formed on or in the high-voltage lead portion in a position intermediate of its longitudinal axis. This provides an effective means of ensuring that the high-voltage lead portion inserted into the high-voltage lead insertion hole will not fall free due to vibrations and other factors, whereby a positive connection can always be formed between the spark plug and the high-voltage lead.

On the other hand, the insulative protecting layer may be a resin filled layer that seals the gap between the inner surface of the outer tube member and the outer surface of the insulator. This offers the advantage of reducing the likelihood of the occurrence of creep discharge on the surface of the insulator (specifically that part which projects from the metallic shell), thereby achieving more effective prevention of "flashover".

The spark plug described above can be fitted on an internal combustion engine by threading the fitting thread portion of the metallic shell into the fitting-screw hole made in the bottom of the plug hole in said engine. In this case, the outer peripheral surface of the outer tube member may be fitted with an anti-vibration member made of an elastic material such as rubber. If the spark plug is fitted on an internal combustion engine, the anti-vibration member is situated between the inner wall surface of the plug hole and the outer peripheral surface of the outer tube member and serves to suppress the lateral vibrations of the outer tube member within the plug hole. As a result, the vibrations from the engine and the like become less likely to be transmitted to the outer tube member, thereby assuring more effective prevention or suppression of the occurrence of friction and other unwanted phenomena between the metallic terminal and the high-voltage lead portion.

In the case just described above, a groove extending in a circumferential direction may be formed in the outer peripheral surface of the outer tube member, with the anti-vibration member being formed in an annular shape that fits into said groove. With this construction, the vibrations that are exerted upon the outer tube member from various directions around the longitudinal axis can be absorbed effectively and, in addition, the anti-vibration member can be fitted on the outer tube member very easily.

Next, the spark plug may be so adapted that the edge of the rear end of the metallic terminal is recessed in the through-hole to a position more inward than the edge of the rear end of the insulator. This helps increase the length of the path over which surface discharge occurs in the insulator and which extends from the edge of the rear end of the metallic shell to that of the metallic terminal. Accordingly, even with a spark plug of a type that is extended in the length of the fitting thread portion (to a value of, e.g., 25 mm or more), typically with a view to permitting more efficient heat dissipation, the occurrence of "flashover" is suppressed and yet the length by which the insulator projects from the opening at the rear end of the metallic shell and, hence, the overall length of the insulator can be shortened. As a result, bends or other defects are less likely to occur during manufacture, typically sintering, of the insulator and its production rate is improved. In addition, the overall weight of the spark plug can be reduced and the metallic shell is less likely to become loose or experience other troubles due to vibrations or impact.

If the distance from the edge of the rear end of the insulator to that of the metallic terminal in the hole through the insulator as measured along the longitudinal axis of said through-hole (i.e., the depth by which the edge of the rear end of the metallic terminal is recessed) is expressed by L5 and the length by which the insulator projects from the rear end face of the metallic shell is expressed by L2, the sum of L5 and L2 is preferably adjusted to 20 mm or more. If L5+L2 is less than 20 mm, the insulator often becomes insufficient in its effectiveness in preventing "flashover". More desirably, a value of at least 25 mm is secured as the sum of L5 and L2. Depending on the value of L2, or the length of projection of the insulator, the length of L5, or the depth by which the edge of the rear end of the metallic terminal is recessed, is adjusted appropriately to secure a value of at least 20 mm, desirably at least 25 mm, as the sum of L5 and L2. Therefore, if the length of projection of the insulator, L2 is reduced in order to shorten the overall length of the insulator, the depth of recess of the edge of the rear end of the metallic terminal, L5 is increased accordingly so as to secure the necessary length of insulation path, L5+L2.

The spark plug may be so adapted that the outer tube member is provided in such a way as to cover the outer peripheral surface of the projecting part of the insulator directly (namely, without an intervening insulative protecting layer), with a tubular high-voltage lead receptacle being provided by that area of the outer tube member which extends more rearward than the end face of said projecting part. In this case, the high-voltage lead portion of the ignition coil connected to the spark plug may be constructed as follows. The high-voltage lead portion is adapted to be composed of an electrically conductive core portion and an insulative coating portion that is made of an insulating, soft, elastic material such as rubber. The insulative coating portion covers the outside of the electrically conductive core portion. The insulative coating portion is provided with a lead-side insulating buffer layer which, in a non-compressed state, has a diameter slightly larger than the inside diameter of the high-voltage lead receptacle. The lead-side insulating buffer layer being pressed into the high-voltage lead receptacle to have the electrically conductive core portion connected to the metallic terminal.

In this construction, no insulating protective layer is provided between the outer tube member and the insulator (in particular, its projecting part). Hence, the outside diameter of the insulator can be sufficiently increased to ensure that it can be fabricated fairly easily even if its overall length is set at a comparatively great value. As a result, the length of that part of the insulator which projects from the metallic shell can be sufficiently increased to further reduce the likelihood of flashover. As a further advantage, by pressing the lead-side insulating buffer layer into the high-voltage lead receptacle, the high-voltage lead portion can be connected to the spark plug more positively, with a smaller likelihood of transmission of vibrations to the joint.

With a view to further reducing the chance of the occurrence of flashover, the edge of the rear end of the metallic terminal is desirably recessed in the through-hole to a position more inward than the edge of the rear end of the insulator. The high-voltage lead portion may be so adapted that the insulative coating portion is provided at the front end of the lead-side insulating buffer layer with an insertion coating portion which, in a non-compressed state, has a smaller diameter than the lead-side insulating buffer layer but which has a slightly larger diameter than the through-hole in the insulator. The insertion coating portion being pressed into the through-hole to have the electrically conductive core portion connected to the metallic terminal. Thus, the insertion coating portion is formed as a connection from the lead-side insulating buffer layer and serves to provide an insulation between the insulator and the electrically conductive core portion within the through-hole, thereby assuring even more positive protection against flashover.

Preferred embodiments of the present invention will be described with reference to the accompanying drawings.

First Embodiment

FIG. 1 is a partial section view of the spark plug of the present invention. The drawing on the left shows various parts of the spark plug by reference numerals and the drawing on the right shows the dimensions of the principal parts of the same spark plug. A spark plug 1 is provided with a tubular metallic shell 3, an insulator 2, a center electrode 5, a ground electrode 7 and an outer tube member 11. The tubular metallic shell 3 is typically made of a carbon steel. The insulator 2 is typically made of an alumina-base ceramic that is fitted in the metallic shell 3, with the front and rear ends axially projecting from the opposite openings of the metallic shell 3. The center electrode 5 is typically made of a nickel alloy that is provided within the insulator 2 except that the front end projects projects out. The ground electrode 7 is typically made of a nickel alloy, one end of which is welded or otherwise coupled to the metallic shell 3 to form a spark discharge gap g with respect to the center electrode 5. The outer tube member 11 is typically made of a carbon steel that covers the outer peripheral surface of that part 2*a* of the insulator 2 which projects rearward from the metallic shell 3 (said part is hereinafter referred to as the "projecting part") and which is coupled at the front end to the metallic shell 3.

A through-hole 19 is axially formed in the insulator 2. A metallic terminal 9 is inserted and fixed in one end portion of the through-hole 19 whereas the center electrode 5 is inserted and fixed in the other end portion of the hole. A resistor 22 is provided within the through-hole 19 between the metallic terminal 9 and the center electrode 5. The opposite ends of the resistor 22 are electrically connected to the metallic terminal 9 and the center electrode 5, respectively, via electrically conductive glass seal layers 21 and 23. The resistor 22 is formed of a resistive composition prepared by mixing a glass powder with a powder of electrically conductive material (and optionally a non-glass ceramic powder) and sintering the mixture by hot pressing or other suitable method.

The rear end portion of the insulator 2 projects from the opening at the rear end of the metallic shell 3 to form the aforementioned projecting part 2*a*. A fitting thread portion 17 is formed on the outer peripheral surface of the front end of the metallic shell 3 and a tapered gas seal portion 3*c* is formed circumferentially on the outer peripheral surface of the metallic shell 3 in a position more rearward than the fitting thread portion 17. Further rearward of the gas seal portion 3*c*, the metallic shell 3 has a circumferential step 3*e* to form a small-diameter portion 3*f*. The outer tube member 11 has an inside diameter that is just sufficient to receive the small-diameter portion 3*f* so that it is axially inserted into the front end portion of said outer tube member.

The outer tube member 11 extends to a position more rearward than the rear end positions of both the insulator 2 and the metallic terminal 9. The outer tube member 11 is coupled to the metallic shell 3 via a circumferential weld 25 so that an axial end face of the outer tube member 11 contacts the step 3*e* of the metallic shell 3. A tool engaging portion 13 is formed on the outer surface in the rear end portion of the outer tube member 11 for helping a tool such as a socket wrench (the inner peripheral surface of which provides tool-side engaging surfaces) to engage the outer tube member 11 from outside. In the illustrated case, the tool engaging portion 13 is such that the exterior shape of a section cut perpendicular to the axis is a regular hexagon. In other words, the tool engaging portion 13 has three pairs of parallel faces that are spaced apart by an angle of about 120 degrees around the longitudinal axis of the outer tube member 11 and they form plug-side engaging faces.

The metallic terminal 9 has a seal portion 9*d*, a lead portion 9*a* that projects from the edge of the rear end of the insulator 2, and a rod portion 9*c* that connects the lead portion 9*a* and the seal portion 9*d*. The seal portion 9*d* is worked to have a threaded or knurled surface so that the gap from the inner surface of the through-hole 19 is sealed with the electrically conductive glass seal layer 21. A flange-like stopper 9*b* regulates the amount by which the lead portion 9*a* projects.

At the circumferential step 2*c* of the insulator 2, its front end engages a rib 3*b* formed on the inner surface of the metallic shell 3 via an annular sheet of packing (not shown) to ensure that the insulator 2 will not slip out of the metallic shell in an axial direction. An annular wire of packing 28 that engages the peripheral edge of a circumferential projecting portion 2*e* of the insulator 2 is provided between the inner surface of the rear opening of metallic shell 2 and the outer surface of the insulator 2. Another annular wire of packing 28 is provided further rearward via talc or otherwise filled layer 27. The insulator 2 is pushed forward against the metallic shell 3 and the edge around its opening is clamped radically inward (toward the packing 28) to form a clamped portion 3*a*, whereupon the metallic shell 3 is fixed to the insulator 2.

Within the outer tube member 11, a rubber insulating buffer layer 15 serving as an insulative protecting layer is provided so that it fills that gap from the outer surface of the insulator 2. The insulating buffer layer 15 is formed as a tube whose outer peripheral surface makes intimate contact with the inner peripheral surface of the outer tube member 11. The insulating buffer layer 15 has an axially extending through-hole 15*a* into which the projecting part 2*a* of the insulator 2 is axially pressed from the front opening of the insulating buffer layer 15. The rear end portion of the insulating buffer layer 15 forms an extension 15*b* that extends to a position substantially flush with the rear end face of the outer tube member 11. That part of the through-hole 15*a* which corresponds to the extension 15*b* provides a high-voltage lead insertion hole into which a high-voltage lead portion of an ignition coil (not shown) is to be inserted and fixed. The high-voltage lead portion 200 typically is composed of an electrically conductive core 201 and a surrounding insulative coating portion 202 that is typically made of rubber. If the high-voltage lead portion 200 is pressed into the through-hole 15*a* while deforming the insulating buffer layer 15 elastically, the resulting friction allows the high-voltage lead portion 200 to be detachably connected to the spark plug 1.

The following are typical examples of the desirable dimensional ranges of the principal parts of the spark plug 1 (the figures in parentheses indicate the specific values adopted in FIG. 1).

Overall length L1 of the spark plug: 80 to 120 mm (90 mm)

Overall length L6 of insulator 2: 63 to 69 mm (66 mm)

If L6 exceeds 69 mm, it often occurs that a shaped powder is difficult to make or defects such as bends are sometimes prone to develop in the insulator 2 during sintering. If L6 is less than 63 mm, it often occurs that adequate values cannot be assured for L2, the length of the projecting part 2*a* of the insulator 2 or L3, the length of the fitting thread portion 17. In the former case, the insulator 2 is not effectively protected against flashover; in the latter case, the spark plug 1 does not have sufficient heat dissipating performance.

Length L2 of the projecting part 2*a* of insulator 2: 20 to 25 mm (23 mm)

Length L3 of fitting thread portion 17: 17.5 to 28 mm (25 mm)

Note that L3, or the length of the fitting thread portion 17 is defined as the distance from the position that gives the reference diameter of the tapered gas seal portion 3*c* (for a thread portion having a diameter of 14 mm, the reference diameter is specified in ISO 2344;1992(E); for those having other diameters, the reference diameter is specified by M+0.8 (in millimeters), with M being the nominal diameter of thread) to the position of the edge of the front end of the metallic shell 3. Adjusting L3 to at least 25 mm is particularly effective in enhancing the heat dissipating performance of the spark plug 1. However, if L3 exceeds 28 mm, L6 or the overall length of the insulator 2 becomes excessive and it often occurs that a shaped powder is difficult make or defects such as bends are sometimes prone to develop in the insulator 2 during sintering.

Length L4 of the extension 15*b* of insulating buffer layer 15: 10 to 25 mm (17 mm). If L4 is less than 10 mm, it often occurs that a leakage current is prone to flow between the lead portion 9*a* of the metallic terminal 9 and the outer tube member 11.

Outside diameter D3 of the outer tube member 11 and the diameter D1 of the outer peripheral surface of the subsequent metallic shell 3: 12 to 17 mm (13.5 mm)

Outside diameter D2 of the small-diameter portion 3*f* of metallic shell 3: 8 to 15 mm (12 mm)

Outside diameter D4 of the projecting part 2*a* of insulator 2: 5.5 to 10.5 mm (7 mm). If D4 is less than 5.5 mm, it often occurs that the insulator 2 is difficult to make. If D4 exceeds 10.5 mm, the insulating buffer layer 15 becomes unduly thin and it often fails to exhibit a satisfactory vibration absorbing effect or the insulation between the surface of the insulator 2 and the outer tube member 11 is sometimes inadequate.

Outside diameter of the fitting thread portion 17: 10 to 14 mm (12 mm)

Taper angle θ of the gas seal portion 3*c*: 62 to 64° (63°)

Now, the function of the spark plug 1 will be described.

As shown in FIG. 1, the spark plug 1 is inserted into a plug hole PH formed in the cylinder head SH of an automotive gasoline engine and fitted on the engine by threading the fitting thread portion 17 of the metallic shell 3 into a fitting-screw hole FS bored through the bottom of the plug hole PH. To perform this fitting operation, a tool such as a socket wrench (whose inner peripheral surface provides tool-side engaging faces) is axially fitted around the hexagonal tool engaging portion 13 formed on the outer peripheral surface of the rear end portion of the outer tube member 11 and the fitting thread portion 17 is screwed into the fitting-screw hole FS. As a result, the spark discharge gap g comes to be positioned within a combustion chamber BR and used as a source of igniting supplied air-fuel mixture. The tapered gas seal portion 3*c* comes in intimate contact with a tapered seal receiving face TS formed on the inner surface of the plug hole PH and serves to seal the gap between the fitting-screw hole FS and the fitting thread portion 17.

In the example under consideration, the cylinder head SH is adapted to be such that the spark plug 1 is fitted in a deeper position through the plug hole PH. In addition, one cylinder is fitted with three spark plugs 1 in order to achieve more efficient firing. To realize this design, the inside diameter of the plug hole PH is set to assume a very small value (about 15 mm) at the base end of the tapered seal receiving face TS. In the above-described construction of the spark plug 1, the tool engaging portion 13 for assisting in screwing the fitting thread portion 17 is formed on the outer peripheral surface of the rear end portion of the outer tube member 11 and the metallic shell 3 is not provided with the conventional tool engaging hexagonal portion. Therefore, even if the plug hole PH is reduced in diameter, the inside diameter of the hole extending through the metallic shell 3 to receive the insulator 2 need not be reduced accordingly since said metallic shell has no obtrusive hexagonal portion.

As a result, the outside a diameter of the insulator 2 can be set to a typical value of about 7 mm which is sufficiently larger than the heretofore possible value (typically about 5 mm) in the case of forming a hexagonal portion around the metallic shell 3 that adequate levels of mechanical strength and withstand voltage can be assured. What is more, when producing the insulator 2 by shaping and sintering a powder of insulating material, there is only a small likelihood for problems such as the difficulty in preparing a shaped powder by pressing or other forming techniques and the occurrence of defects such as bends during sintering. This contributes to satisfy the process economics. In addition, the tool engaging portion 13 of the spark plug 1 is situated close enough to the opening of the plug hole PH to allow for easy spark plug fitting procedures.

Generally speaking, the farther away from the fitting thread portion 17, the smaller the likelihood of the plug hole PH to be subject to limitations from the space on the cylinder head SH. In the example under consideration, this empirical fact is utilized and that part of the plug hole PH which corresponds to the tool engaging portion 13 is slightly increased in diameter so as to secure the allowance for engagement with tightening tools such as a socket wrench.

The rubber insulating buffer layer 15 is provided between the outer tube member 11 and the insulator 2. If vibrations from the engine and so forth are exerted on the outer tube member 11, the buffer layer 15 retards their transmission to the connection between the metallic terminal 9 and the high-voltage lead portion 200, thereby reducing the possibility that friction, wear and other unwanted phenomena occur between those elements.

Figure 2A:
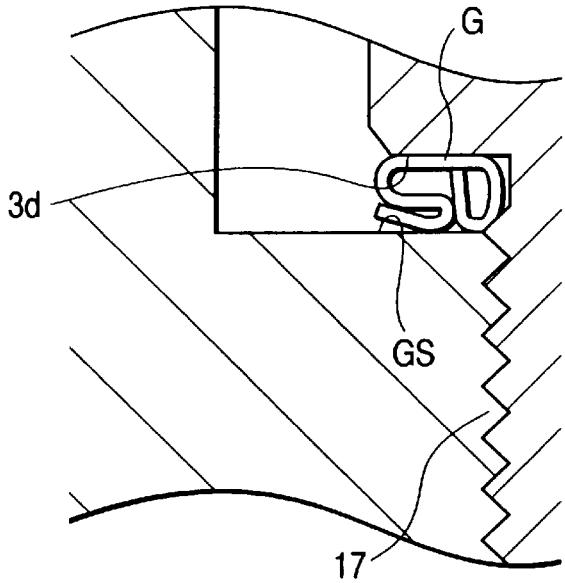
FIG. 2A is an enlarged partial section view of a modification of the gas seal portion of the spark plug of first embodiment.

FIG. 2A shows a modification of the tapered gas seal portion 3*c* of the metallic shell 3. It may be replaced by a gas seal portion 3*d* of such a shape that it is substantially perpendicular to the longitudinal axis of the metallic shell 3. In this alternative case, a gasket receiving surface GS of a corresponding shape is formed on the inner surface of the cylinder head SH and a metallic gasket G is fitted at the gas end of the fitting thread portion 17. The gasket G typically has an S-shaped cross section; if the fitting thread portion 17 is screwed into the fitting-screw hole FS, the gasket G is deformed as if it were squeezed between the gas seal portion 3*d* and the gasket receiving surface GS, thereby effectively sealing the gap between the fitting-screw hole FS and the fitting thread portion 17.

Figure 2B:
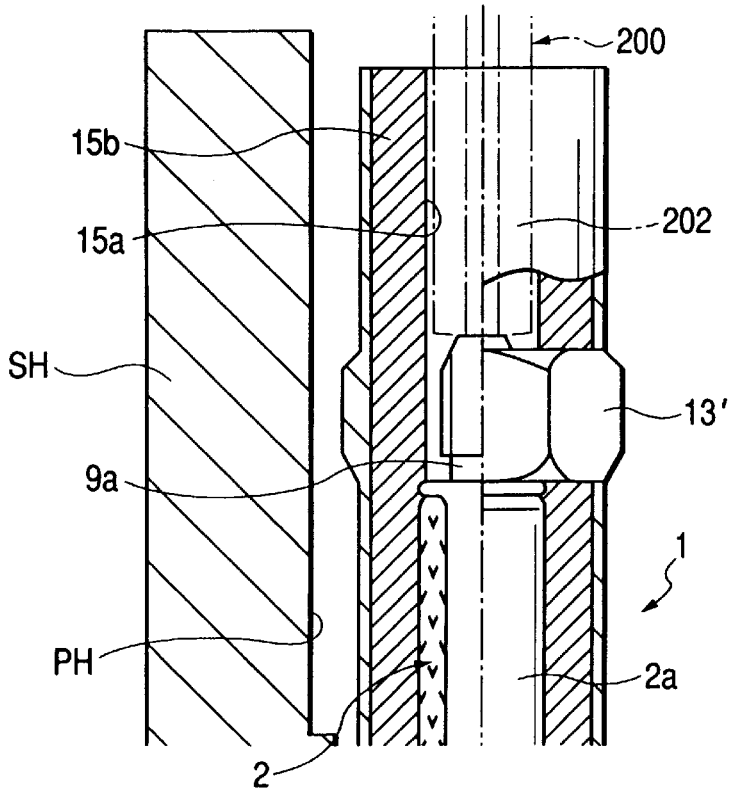
FIG. 2B is an enlarged partial section view of another modification of the first embodiment.

FIG. 2B shows a modification of the first embodiment. In this modification, the tool engaging portion 13' is provided more rearward than the insulator 2, but is provided not more rearwadly than the lead portion 9*a* which is a part of the metallic terminal 9. In the present invention, the tool engaging portion can be thus provided.

Second Embodiment

Figure 3:
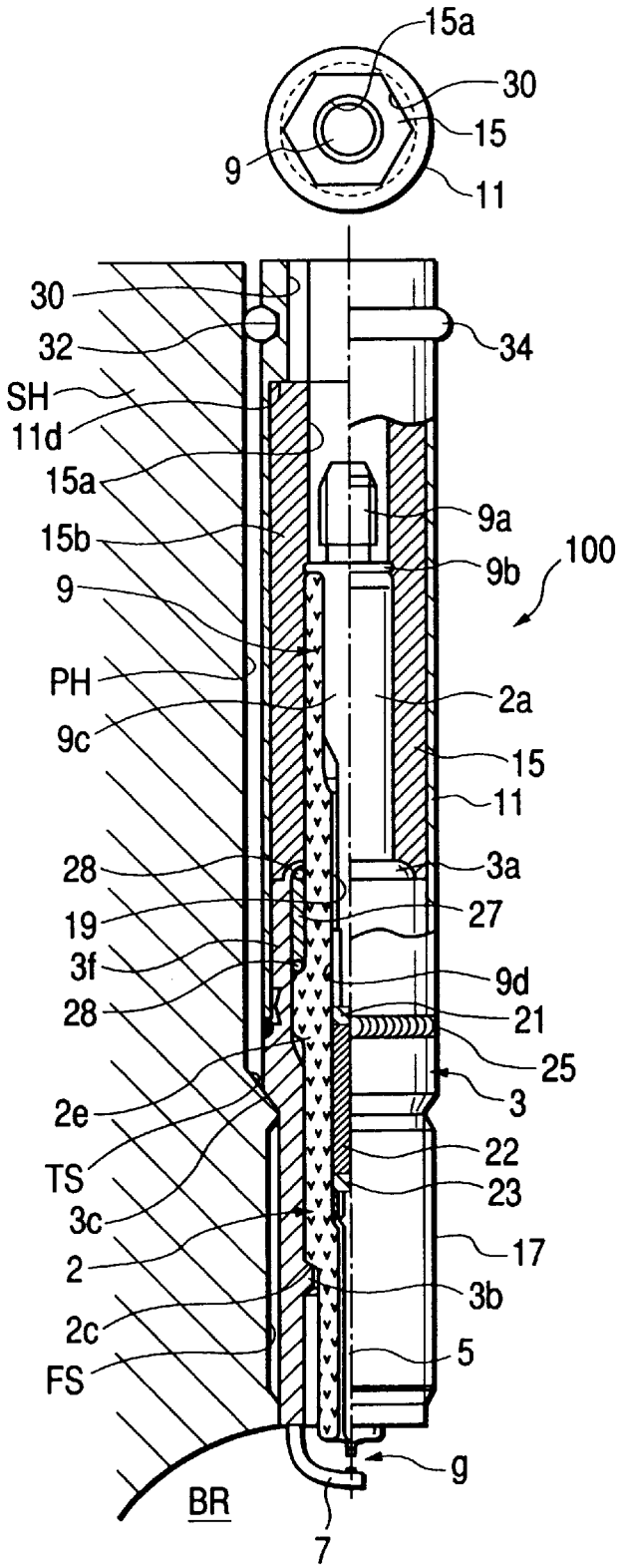
FIG. 3 shows in partial longitudinal section and plan view the spark plug according to second embodiment of the invention.

FIG. 3 shows a spark plug 100 according to second embodiment of the invention. Those parts which are common to both the spark plug 1 of the first embodiment and the spark plug 100 of the second embodiment are identified by the same numerals and will not be described in detail. The spark plug 100 has an engaging hole 30 as the tool engaging portion which is open to the rear end face of the outer tube member 11 and whose inner peripheral surface provides plug-side tool engaging faces in a hexagonal cross-sectional shape. The rear end portion of the outer tube member 11 has a comparatively thick wall to permit the formation of the engaging hole 30. On the other hand, the extension 15*b* of the insulating buffer layer 15 is reduced in length so that its rear end face contacts a step lid formed at the edge of the axial front end of the engaging hole 30. A circumferential groove 32 is formed in the outer peripheral surface of the rear end portion of the outer tube member 11 and a rubber-made anti-vibration member 34 in annular form is fitted into the groove 32.

To fit the spark plug 100 on the cylinder head, a tool such as a hexagonal wrench (whose outer peripheral surface provides tool-side engaging faces) is axially fitted into the engaging hole 30 through the opening in the rear end face of the outer tube member 11 and the fitting thread portion 17 is screwed into the fitting-screw hole FS. In this construction, the tool engages the engaging hole 30 from inside and there is no particular need that the allowance for engagement with the tool be secured outside the outer tube member 11. As a result, the inside diameter of the plug hole PH can be further reduced.

When the spark plug 100 is fitted on the cylinder head, the anti-vibration member 34 is situated between the inner wall surface of the plug hole PH and the outer peripheral surface of the outer tube member 11 (in the example under consideration, the anti-vibration member 34 is slightly compressed between the two elements) and serves to suppress the lateral vibrations of the outer tube member 11 within the plug hole PH. This further retards the transmission of the vibrations from the engine and so forth to the outer tube member 11. It should be noted that in order to achieve an enhanced anti-vibrational effect, the anti-vibration member 34 should be provided on the outer peripheral surface of the outer tube member 11 in a position axially the farthest away from the fitting thread portion 17. In the above-described construction of the spark plug 100, no tool engaging portion is formed on the outer peripheral surface of the outer tube member 11 in a position the farthest away from the fitting thread portion 17, namely, the rear end portion of the outer tube member 11; this may well be said to offer an advantageous way to secure an effective position for providing the anti-vibration member 34.

Figure 4:
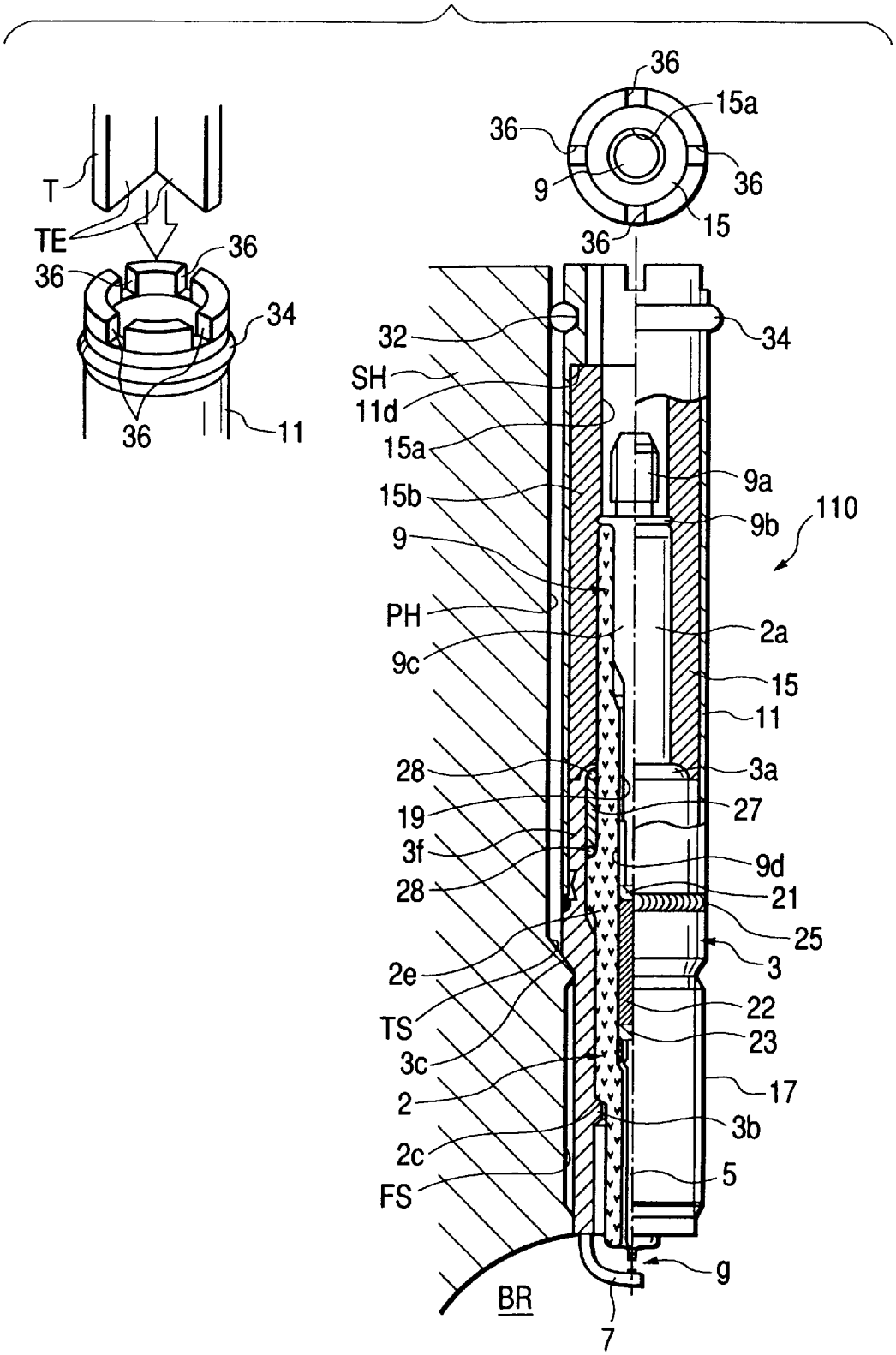
FIG. 4(*a*) and 4(B) show in partial longitudinal section and plan view the spark plug according to a modification of second embodiment, together with a perspective view showing how the rear end portion of the spark plug works.

FIG. 4 shows a modification of the second embodiment, in which the engaging hole 30 shown in FIG. 3 is replaced by a plurality of radically cut engaging grooves 36 that are open at an end face of the outer tube member 11. In the spark plug 110 in FIG. 4, four engaging grooves 36 are radically spaced apart along the circumference. The respective grooves 36 are brought into engagement with corresponding tool-side engaging portions TE (which are crossed in the modification under consideration) and the fitting thread portion 17 is screwed into the fitting-screw hole FS. It should be noted that the spark plugs 100 and 110 shown in FIGS. 3 and 4 may also be provided with the tool engaging portion 13 (see FIG. 1) on the outer surface of the rear end portion of the outer tube member 11. This design provides greater convenience by expanding the range of choosing applicable tools.

Third Embodiment

Figure 5:
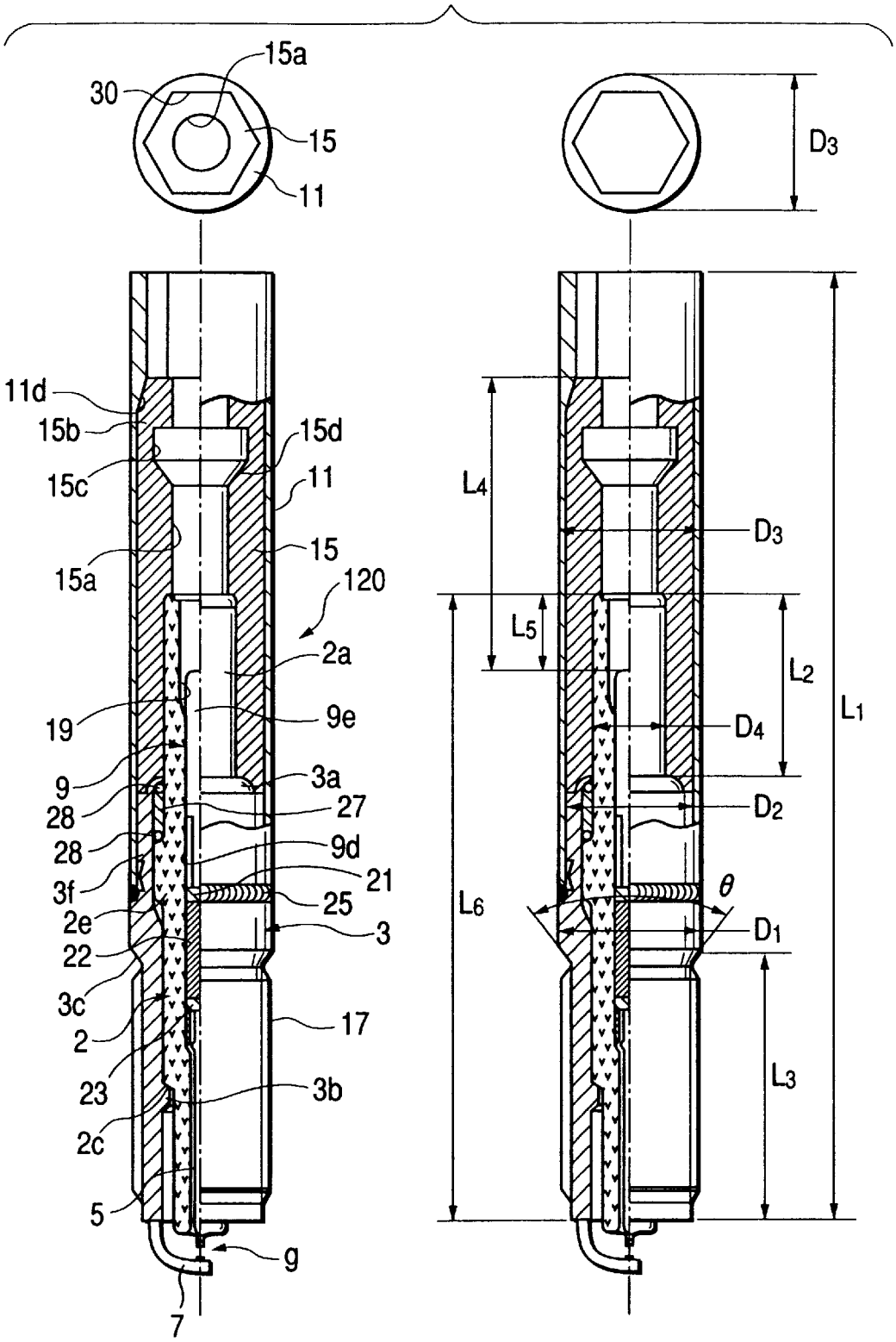
FIG. 5(*a*) and 5(B) show in partial longitudinal section and plan view of the spark plug according to third embodiment of the invention.

FIG. 5 shows a spark plug 120 according to third embodiment of the invention. The drawing on the left shows various parts of the spark plug by reference numerals and the drawing on the right shows the dimensions of the principal parts of the same spark plug. Those parts which are identical to the parts of the spark plug 1 of the first embodiment and the spark plug 100 of the second embodiment are identified by the same numerals and will not be described in detail.

The spark plug 120 is essentially the same as the spark plug 100 of the second embodiment as shown in FIG. 3, except that the metallic terminal 9 (more specifically, its lead portion 9*e*) has the edge of its rear end recessed in the through-hole 19 to a position more inward than the edge of the rear end of the insulator 2. This helps increase the length of the path over which surface discharge occurs in the insulator 2 and which extends from the edge of the rear end of the metallic shell 3 to that of the metallic terminal 9 and the insulator 2 becomes more resistant to flashover. In addition, the overall length of the insulator 2 is sufficiently reduced to facilitate its manufactures.

Figure 6:
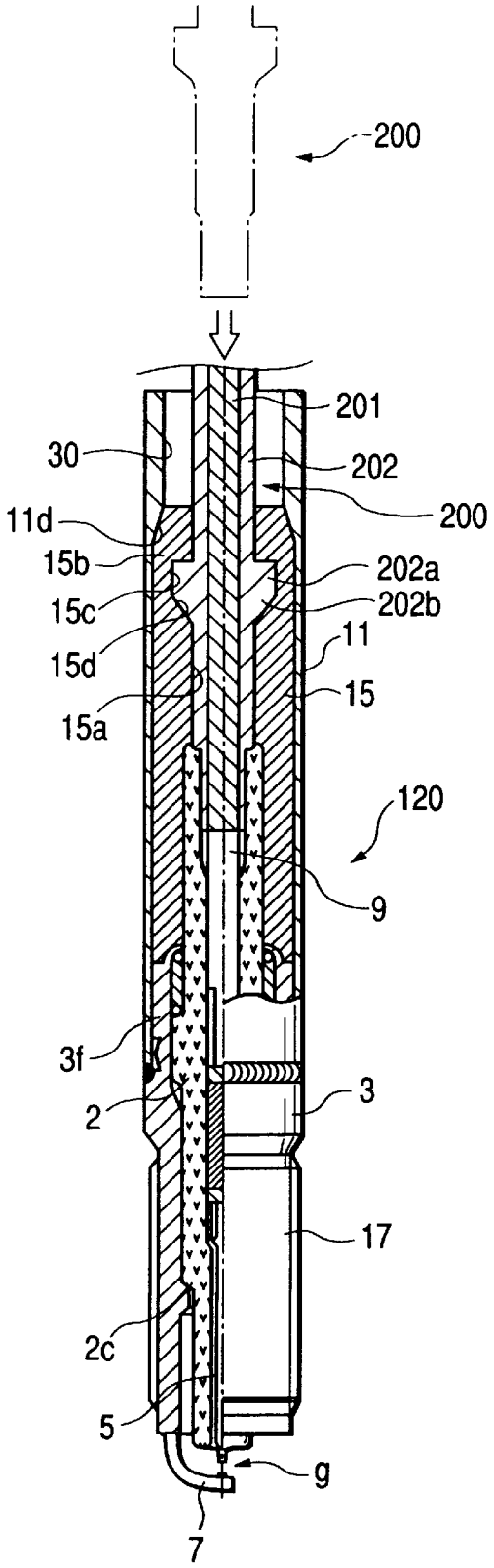
FIG. 6 is a partial longitudinal section of the spark plug shown in FIG. 5, with a high-voltage lead portion connected thereto.

Another feature of the spark plug 120 is that an engaging recess 15c is formed in an intermediate position of that area of the through-hole 15*a* in the insulating buffer layer 15 which serves as the high-voltage lead insertion hole. As shown specifically in FIG. 6, the high-voltage lead portion 200 has a circumferential lip 202*a* formed on the insulative coating layer 202. When the high-voltage lead portion 200 is pressed into the high-voltage lead insertion hole, the lip 202*a* engages the recess 15*c*, thereby ensuring that the high-voltage lead portion 200 will not slip out of the through-hole 15*a*. This provides an effective means of preventing the inserted high-voltage lead portion 200 from falling free due to vibrations and other external forces. It should be noted that the outer peripheral surface of the front end portion of the lip 202*a* is tapered to facilitate the inserting of the high-voltage lead portion 200 into the high-voltage lead insertion hole and a tapered surface 15*d* is also formed in the corresponding position of the engaging recess 15*c*.

The following are typical examples of the desirable dimensional ranges of the principal parts of the spark plug 120 (excepting those which have the values as in the spark plug 1 shown in FIG. 1; the figures in parentheses indicate the specific values adopted in FIG. 5).

Overall length L1 of the spark plug: 70 to 120 mm (90 mm)

Overall length L6 of insulator 2: 52 to 66 mm (60 mm)

Length L2 of the projecting part 2*a* of insulator 2: 9 to 23 mm (17.5 mm)

Distance L5 from the edge position of the rear end of insulator 2 to the edge of the rear end of metallic terminal 9 in through-hole 19: 0 to 16 mm (7.5 mm)

L5+L2: At least 20 mm (desirably at least 25 mm). Below 20 mm, the insulator sometimes fails to be effectively protected against flashover.

Length L4 of the extension 15*b* of insulating buffer layer 15: 10 to 30 mm (28 mm). If L4 is less than 10 mm, it often occurs that a leakage current is prone to flow between the lead portion 9*a* of the metallic terminal 9 and the outer tube member 11. If L4 exceeds 30 mm, the tool engaging hole 30 is not deep enough to allow for smooth plug fitting operation.

Fourth Embodiment

Figure 7:
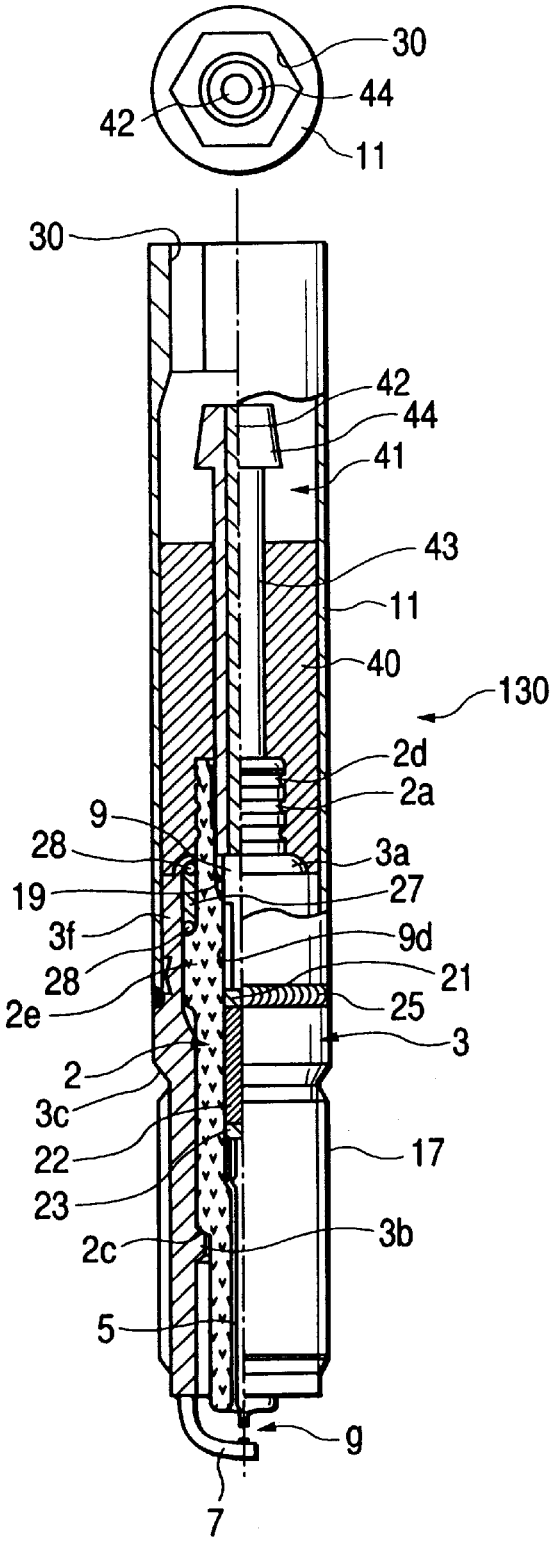
FIG. 7 shows in partial longitudinal section and plan view of the spark plug according to fourth embodiment of the invention.

FIG. 7 shows a spark plug 130 according to fourth embodiment of the invention. Those parts of the spark plug 130 which are identical to the parts of the spark plug 1 of Example 1 and the spark plug 100 of Example 2 are identified by the same numerals and will not be described in detail. In the spark plug 130, the insulative protecting layer is provided by a resin-filled layer 40 that seals the gap between the inner surface of the outer tube member 11 and the outer surface of the insulator 2. As a result, the likelihood of the occurrence of creep discharge on the surface of the projecting part 2*a* of the insulator 2 is considerably reduced to achieve a marked improvement in resistance to flashover. The reduced likelihood of creep discharge offers the added advantage of making the projecting part 2*a* in a shorter length than in the third embodiment and so forth. This contributes to shorten the overall length of the insulator 2, thus making it easier to fabricate. Note that corrugations 2*d* are formed on the surface of the projecting part 2*a* in order to enhance the bond between the insulator 2 and the resin filled layer 40.

As in the third embodiment, the metallic terminal 9 has the edge of its rear end recessed in the through-hole 19 to a position more inward than the edge of the rear end of the insulator 2. As shown, a lead pick-up member 41 is inserted into the through-hole 19 to contact the rear end face of the metallic terminal 9 such that the rear end portion of the pick-up member 41 which provides a connection to the high-voltage lead projects from the resin filled layer 40. The lead pick-up member 41 comprises an electrically conductive core portion 42 and an insulative coating portion 43 (which may be molded from a plastic material as an integral part of the electrically conductive core portion 42), with a circumferential flange 44 being formed on the outer peripheral surface of the rear end portion of the insulative coating portion 43.

Figure 8:
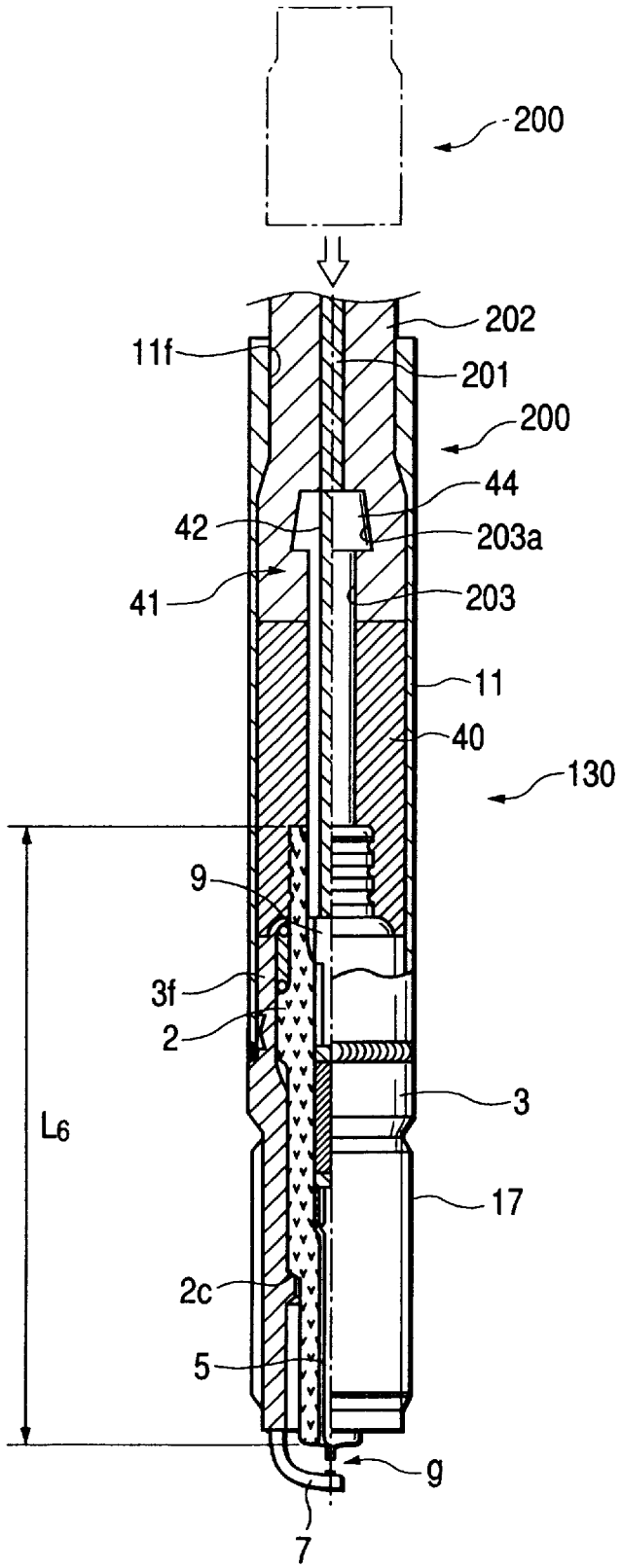
FIG. 8 is a partial longitudinal section of the spark plug shown in FIG. 7, with a high-voltage lead portion connected thereto.

As shown specifically in FIG. 8, the high-voltage lead portion 200 is such that the insulative coating layer 202, when it is in a non-compressed state. The high-voltage lead portion 200 has a diameter slightly larger than the inside diameter of the outer tube member 11 so that it can be pressed into a high-voltage lead receptacle 11*f* that is formed rearward of the resin filled layer 40 in the outer tube member 11. The insulative coating layer 202 has a lead pick-up member engaging portion 203 formed at the axial front end in registry with an extension of the electrically conductive core portion 201 and the rear end portion of the aforementioned lead pick-up member 41 (specifically that part which projects from the resin filled layer 40) is pressed to fit into the engaging portion 203. Note that the lead pick-up member engaging portion 203 has a circumferential recess 203*a* formed in such a way that it engages the flange 44, thereby ensuring that the high-voltage lead portion 200 will not slip out of the high-voltage lead receptacle 11*f*.

Also note that in the spark plug 130, the insulator 2 has an overall length L6 of about 51 to 61 mm (specifically 51 mm in this embodiment).

Fifth Embodiment

Figure 9:
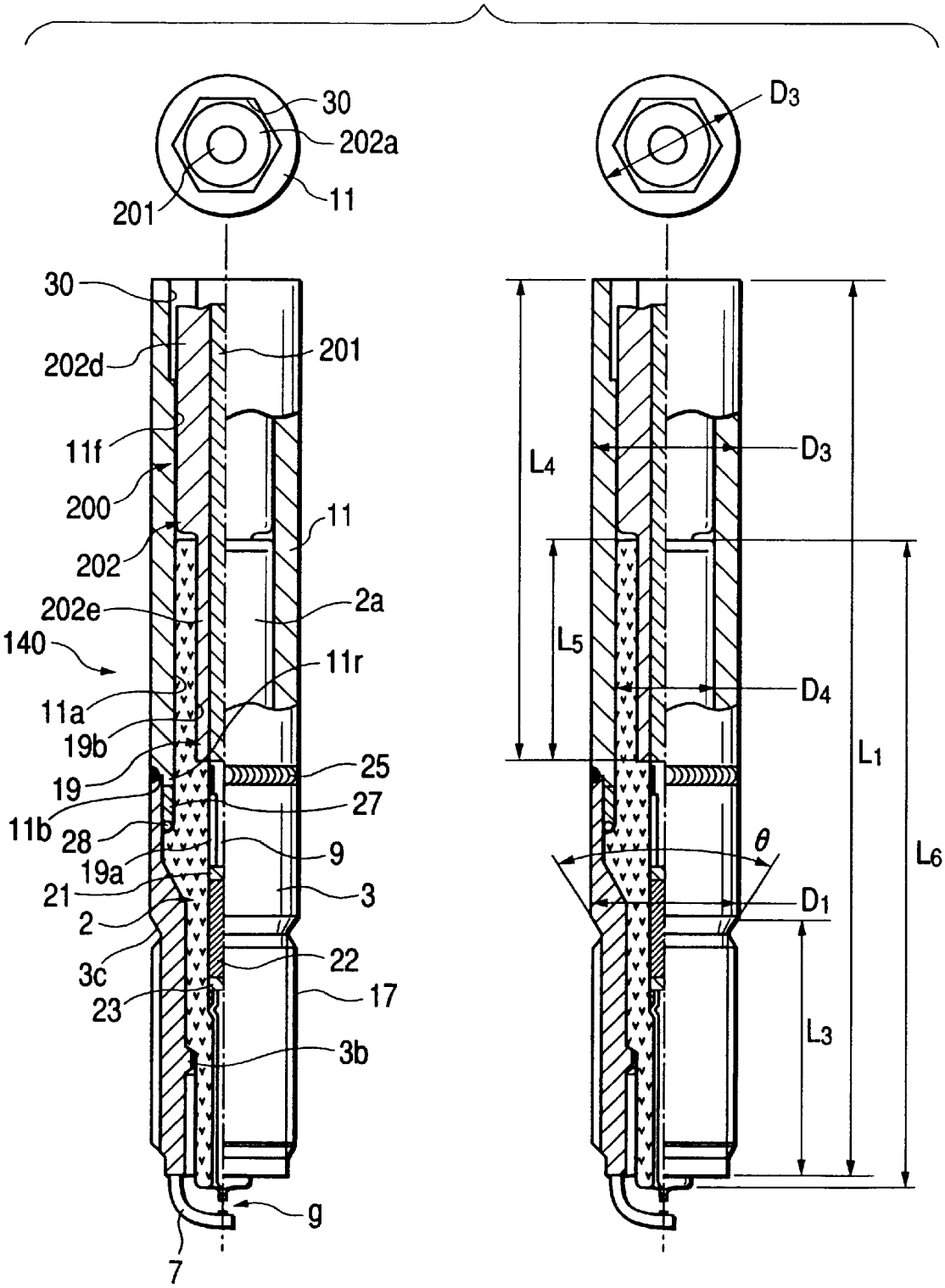
FIG. 9(*a*) and 9(B) show in partial longitudinal section and plan view of the spark plug according to fifth embodiment of the invention.
Figure 10:
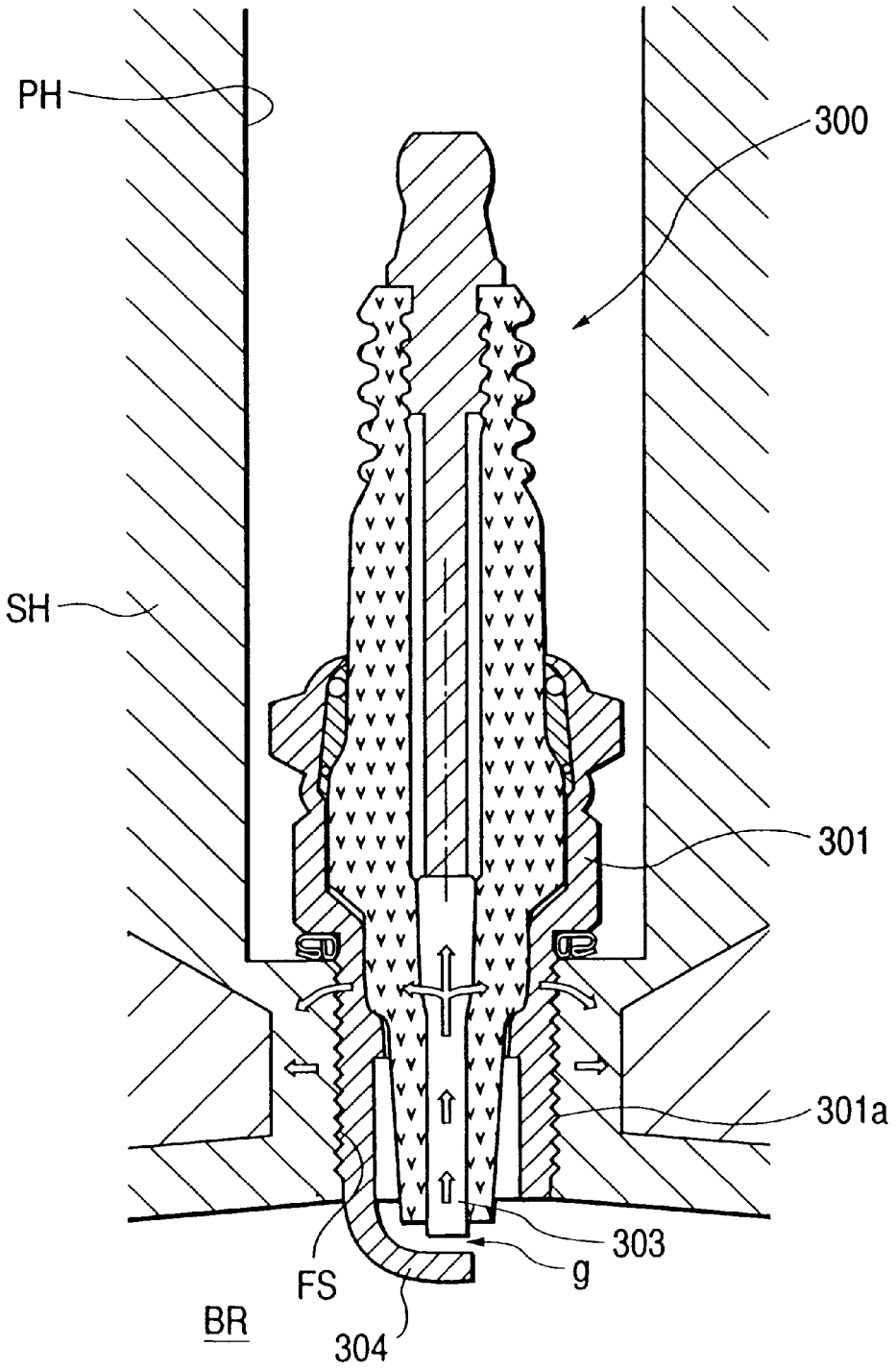
PRIOR ART FIG. 10
FIG. 10 is a longitudinal section of a conventional spark plug.

FIG. 9 shows a spark plug 140 according to fifth embodiment of the invention. The drawing on the left shows various parts of the spark plug by reference numerals and the drawing on the right shows the dimensions of the principal parts of the same spark plug. Those parts which are common to both the spark plug 1 of the first embodiment and the spark plug 140 of the fifth embodiment are identified by the same numerals and will not be described in detail. In the spark plug 140, the outer tube member 11 is provided to cover the outer peripheral surface of the projecting part 2*a* of the insulator 2 in such a way that it is in direct contact with the latter (namely without the intervening insulative protecting layer used in the first to fourth embodiment). Another feature of the spark plug 140 is that the tubular high-voltage lead receptacle 11*f* is provided by that area of the outer tube member 11 which extends to a position more rearward than the end face of the projecting part 2*a*.

The high-voltage lead portion 200 is composed of an electrically conductive core portion 201 and a surrounding insulative coating layer 202 that is provided with a lead-side insulating buffer layer 202*d* which, in a non-compressed state, has a diameter slightly larger than the inside diameter of the high-voltage lead receptacle 11*f*. The lead-side insulating buffer layer 202*d* is axially pressed into the high-voltage lead receptacle 11*f* so that the electrically conductive core portion 201 is connected to the metallic terminal 9.

The edge of the rear end of the metallic terminal 9 is recessed in the through-hole 19 to a position more inward of the edge of the rear end of the insulator 2. The high-voltage lead portion 200 is so adapted that the insulative coating portion 202 is provided at the front end of the lead-side insulating buffer layer 202*d* with an insertion coating portion 202*e* which, in a non-compressed state, has a smaller diameter than said lead-side insulating buffer layer 202*d* but which has a slightly larger diameter than the through-hole 19 in the insulator 2. The insertion coating portion 202*e*, together with the inwardly positioned, electrically conductive core portion 201, is pressed into the through-hole 19 in the insulator 2, whereupon said core portion 201 is connected to the metallic terminal 9.

The rear end portion of the metallic shell 3 has no area that is to be clamped to have the metallic shell 3 fixed to the insulator 2. Instead, a packing 28 and a talc or otherwise filled layer 27 are provided in the gap between the rear end portion of the metallic shell 3 and the outer peripheral surface of the insulator 2, and a rib-like portion 11*r* formed around the inner edge of the front end face of the outer tube member 11 is fitted into the same gap. As shown, the weld 25 is formed to span the outer peripheral surface of the rear end edge portion of the metallic shell 3 and that of the abutting front end edge portion of the outer tube member 11.

According to the above-described construction of the spark plug 140, no insulative protective layer is provided between the outer tube member 11 and the projecting part 2*a* of the insulator 2 and this allows for a corresponding increase in the outside diameter of the insulator 2. Hence, the insulator 2 can be manufactured fairly easily even if its overall length is set to have a comparatively large value. As a consequence, the length of the projecting part 2*a* as measured from the metallic shell 3 can be sufficiently increased to further reduce the likelihood of the occurrence of flashover. As a further advantage, the lead-side insulating buffer layer 202*d* is pressed into the high-voltage lead receptacle 11*f*, thereby ensuring more positive connection of the high-voltage lead portion 200 to the spark plug 140 while retarding the transmission of vibrations to the joint. In addition, the insertion coating portion 202*e* is formed as a connection from the lead-side insulating buffer layer 202*d* and serves to provide an insulation between the insulator 2 and the electrically conductive core portion 201 within the through-hole 19, thereby assuring even more positive protection against flashover.

The following are typical examples of the desirable dimensional ranges of the principal parts of the spark plug 140 (the figures in parentheses indicate the specific values adopted in FIG. 9).

Overall length L1 of the spark plug: 72 to 92 mm (90 mm)

Overall length L6 of insulator 2: 63 to 69 mm (66 mm)

Distance L5 from the edge position of the rear end of insulator 2 to the edge of the rear end of metallic terminal 9 in through-hole 19: 20 to 25 mm (23 mm)

Outside diameter D4 of the projecting part 2*a* of insulator 2 beyond metallic shell 3: 7.5 to 9.5 mm (9 mm). Alternatively, D3-6≦D4≦D3-4 (in millimeters), provided that D3 is the outside diameter of the outer tube member 11.

What is claimed is:

1. A spark plug comprising:

a shaft-shaped center electrode;

a tubular main metallic shell that is provided exterior to said center electrode, said tubular main metallic shell having a fitting thread portion formed on its outer peripheral surface;

a ground electrode that is coupled to the main metallic shell to oppose to said center electrode to form a spark discharge gap therefrom;

an insulator that is provided within said main metallic shell with its rear end portion projecting from the opening at the rear end of said main metallic shell, the front end being the one of the longitudinal axis of said center electrode where the spark discharge gap is formed and the rear end being opposite to said front end, said insulator having an axially extending through-hole in which said center electrode is provided;

a shaft-shaped metallic terminal which, within the through-hole in said insulator, is coupled to the rear end of said center electrode either directly or indirectly via a separate member formed of an electrically conductive material;

a tool engaging portion to which a tool engages for screwing said fitting thread portion of said main metallic shell into a fitting-screw hole in an internal combustion engine, said tool engaging portion being provided more rearward than the rear end position of at least one of said metallic terminal and said insulator;

an outer tube member that covers the outer peripheral surface of the rear end portion of said insulator which projects from said main metallic shell with its front end being coupled to said main metallic shell;

said tool engaging portion being formed in the rear end portion of said outer tube member; wherein said tool engaging portion is formed on the outer surface of the rear end portion of said outer tube member such that said tool comes into engagement from outside and that the engaging faces on plug side are so shaped as to ensure that said outer tube member is prevented from rotating about its longitudinal axis relative to the engaging faces on tool side.

2. The spark plug according to claim 1, wherein said engaging faces on plug side comprise at least one pair of parallel faces that lie on opposite sides of the central axis through said outer tube member.

3. The spark plug according to claim 1, wherein the inside of said outer tube member is lined with an insulative protecting layer that fills the gap from the outer surface of said insulator, and said insulative protecting layer comprises a polymeric material.

4. The spark plug according to claim 3, wherein said outer tube member is so shaped as to extend more rearward that the rear end positions of both said insulator and said metallic terminal;

said insulative protecting layer being formed as an insulating buffer layer comprising an insulating, soft, elastic material, said insulating buffer layer having an extension passing through said outer tube member up to a point more rearward than the rear end positions of both said insulator and said metallic terminal; and a high-voltage lead insertion hole is formed in said extension along the axis direction thereof in a position corresponding to said metallic terminal, the high-voltage lead portion of an ignition coil being inserted and fixed through a high-voltage lead insertion hole.

* * * * *